US008606180B2

(12) United States Patent
Santinato et al.

(10) Patent No.: US 8,606,180 B2
(45) Date of Patent: Dec. 10, 2013

(54) USER INTERFACE FOR CONTROLLING A HOUSEHOLD ELECTRICAL APPLIANCE REMOTELY CONNECTED THERETO

(75) Inventors: Matteo Santinato, Albignasego (IT); Davide Parachini, Cassano Magnago (IT); Alessandro Boer, Biandronno (IT); Giulio Roncoroni, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 835 days.

(21) Appl. No.: 12/266,644

(22) Filed: Nov. 7, 2008

(65) Prior Publication Data

US 2009/0118848 A1 May 7, 2009

(30) Foreign Application Priority Data

Nov. 7, 2007 (IT) ..... MI2007A2129

(51) Int. Cl.
*H04B 17/00* (2006.01)

(52) U.S. Cl.
USPC ..... 455/41.2; 455/418; 455/419; 455/420; 455/41.1; 455/92; 455/344; 455/557; 455/550; 219/413; 219/702; 219/757; 219/715

(58) Field of Classification Search
USPC ..... 455/418–420, 41.1–41.2, 92, 344, 557; 219/413, 702, 757, 715
See application file for complete search history.

(56) References Cited

U.S. PATENT DOCUMENTS

| | | | | |
|---|---|---|---|---|
| 5,839,097 | A * | 11/1998 | Klausner | 340/12.3 |
| 5,847,447 | A * | 12/1998 | Rozin et al. | 257/678 |
| 6,786,058 | B2 | 9/2004 | Sanna | |
| 6,936,802 | B2 * | 8/2005 | Ishikawa et al. | 219/702 |
| 7,090,141 | B2 | 8/2006 | Roh et al. | |
| 7,173,513 | B2 * | 2/2007 | Laaser | 340/3.1 |
| 7,216,944 | B2 * | 5/2007 | Oyler et al. | 312/311 |
| 7,293,422 | B2 * | 11/2007 | Parachini et al. | 62/126 |
| 7,504,951 | B2 * | 3/2009 | Phipps et al. | 340/572.7 |
| 8,319,599 | B2 * | 11/2012 | Aisa et al. | 340/3.1 |
| 2002/0063633 | A1 * | 5/2002 | Park | 340/825.69 |
| 2003/0229404 | A1 * | 12/2003 | Howard et al. | 700/17 |
| 2004/0058706 | A1 * | 3/2004 | Williamson et al. | 455/557 |
| 2005/0084118 | A1 * | 4/2005 | Schaupert et al. | 381/110 |
| 2007/0156265 | A1 * | 7/2007 | McCoy et al. | 700/83 |
| 2008/0166895 | A1 | 7/2008 | McCoy et al. | |

FOREIGN PATENT DOCUMENTS

JP 2003319573 A 11/2003

* cited by examiner

*Primary Examiner* — Edward Urban
*Assistant Examiner* — Ganiyu A Hanidu

(57) ABSTRACT

A user interface arranged at least to display, on a display unit or on a display panel, information relative to the operation of a household electrical appliance with which the interface is associated, the appliance presenting functional members controlled in their operation by a control unit, and an external housing provided with an aperture with its own closure door; the interface is positionable on and fastenable to the exterior of the housing of the electrical appliance, remote wire-less data communication and transmission means being associated with the control unit and with the interface to enable the data to be transmitted from the interior of the electrical appliance to the interface through the housing. A household electrical appliance with this interface is also claimed.

19 Claims, 3 Drawing Sheets

USER INTERFACE FOR CONTROLLING A HOUSEHOLD ELECTRICAL APPLIANCE REMOTELY CONNECTED THERETO

BACKGROUND OF THE INVENTION

1. Field of the Invention

The present invention generally relates to a user interface associable with a household electrical appliance.

2. Description of the Related Art

In such a household electrical appliance it is known to provide a user interface, for example positioned on that external side of the door opposing that facing the internal chamber of the electrical appliance (as in a refrigerator) or directly on an external side of the housing (as in a washing machine or a dishwasher, for example). This situation is usually the case in an electrical appliance of free-standing type used either alone or within a kitchen cabinet, but always independently such that this interface is always accessible to a user and its presence does not prevent the positioning of the electrical appliance in a position for use, including in a modular kitchen.

In contrast, when the electrical appliance is of built-in type, the presence of the user interface on the outside of its housing can impede insertion of the appliance into a compartment of a modular kitchen, but in any event prevents application of a complete insulation covering, for example with panelling on the front door of the appliance on which this covering is installed, without special adaptations being made to the appliance, such as a specific window. It follows that built-in electrical appliances are frequently designed and shaped, with regard to that side thereof provided with the door, differently from free-standing appliances; this results in higher constructional and design costs for such appliances, with special regard to the user interface. It must in any event be noted that the same problem could also arise in certain free-standing appliances.

Small electrical appliances are also known, for example toothbrushes, which are not provided with electrical connections between the power base and the appliance. In these types of appliance, a battery powering the appliance is charged by magnetic coupling, based on the principle of operation of a transformer, where the secondary winding is positioned within the appliance, separated by a thin wall of non-conductive material, such as plastic. This solution is not however applicable to control units and/or user interfaces positioned on the external panel of a built-in electrical appliance as the thickness of the panel, typically between 1 and 4 cm, does not enable an effective coupling of this type to be obtained, considering the limitation on the electric power normally used in the household environment and in particular installed in electrical appliances.

SUMMARY OF THE INVENTION

The invention relates to a user interface applicable to the outside of the housing of a panel-enclosed or exposed household electrical appliance, which enables the operative state of the electrical appliance to be at least easily and safely determined and/or set, but which does not present the limitations of known solutions.

One aspect of one embodiment of the present invention is to provide a user interface which can be used effectively on a built-in and paneled electrical appliance, without this influencing the insertion of the appliance into a compartment of a kitchen unit and without its presence preventing panelling of the front side of the appliance (on which the panel is located and at which the openable door is present) or requiring holes in this latter such as to modify the overall appearance of the modular unit.

One aspect of one embodiment of the present invention is to provide a user interface of the stated type which is easy to install and use.

One aspect of one embodiment of the present invention is to provide a user interface of low power consumption which does not need to be powered by battery or by electric cabling in order to operate completely.

BRIEF DESCRIPTION OF THE DRAWINGS

The present invention will be more apparent from the accompanying drawings, which are provided by way of non-limiting example and in which.

DETAILED DESCRIPTION

In the present document, a household electrical appliance includes a unit, such as a refrigerator, a washing machine, a washing-drying machine, a dryer, an oven or a dishwasher, presenting a housing defining at least one internal chamber (for example a food preservation compartment) having at least one aperture on which a door is provided to give access to the compartment, but also for its heat-proof and/or waterproof closure. The electrical appliance has its own functional members (for example a rotary drum driven by its own motor, movable spray arms or a refrigeration circuit) to allow its normal use for the purpose for which it is designed. These members are electrically powered and are controlled in their operation by a control unit disposed in a suitable position within the housing.

Figure 4:
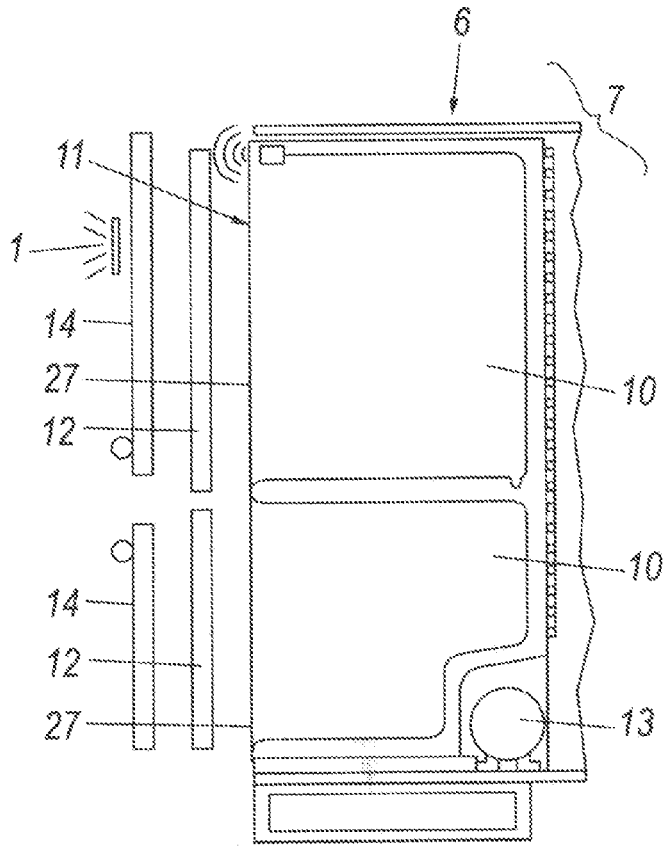
FIG. 4 is a schematic view in longitudinal section of a built-in electrical appliance, in particular a refrigerator, provided with the interface of the invention.

With reference to the figures, an interface of the invention is indicated overall by 1 and comprises a display unit 2 and/or a display panel 3, for example comprising one or more push-buttons and/or display elements (such as LEDs or the like) 4. This interface comprises a casing 5 to be coupled (fixed or removable) by usual means (for example magnetic, glue or mechanical such as clips, screws or the like) to a housing 6 of a household electrical appliance 7. This latter comprises at least one internal cavity 10, open at 27 on a side 11 at which a door 12 is present (to tightly close the cavity 10) and presents usual members 13 (for example a compressor of a refrigeration circuit in FIG. 4) for its normal operation.

The door 12 is paneled, i.e. is faced with a panel 14 formed such as to be able to inset the appliance into a modular unit 16 of a kitchen 17, said panel 14 having the same features as the panels or facings of this latter. The interface 1 is positioned on the panel 14 (or on a panel of one of the parts of the appliance if these are more than one); alternatively, it can be coupled directly to the appliance door 12.

In both cases the interface 1 is connected without wires to an appliance control unit 21, such that it is possible at least to display, on the display unit 2 or on the panel 3, information relative to the appliance operation. This information, together with the energy for its operation, are transmitted to the interface without any connection cables physically connecting the control unit 21, which senses the information at the interface.

The connection between this latter and the unit 21 is achieved by low power consumption radio waves (ISM or 2.4 GHz) or, preferably, by utilizing resonant electromagnetic coupling technology; this avoids the use of other data collection and transfer methods which require much more energy, such as bluetooth connections. The remote connection protocol (for example via radiofrequency) is hence aimed at energy saving and does not include the facility for continuous video-audio reproduction.

The interface 1 can simply be a member displaying data (for example the refrigerator internal temperature or the time remaining to the end of wash) by its own display unit. However, in a different embodiment, the interface 1, if provided with data entry devices such as keys, can also send (and not only receive) data to the unit 21 to control the electrical appliance operation without opening its door 20.

More specifically, the interface 1 comprises an electromagnetically resonant circuit 30 (or via radio) coupled to another oscillating circuit 31 associated with the interior of the appliance housing 12, which is forced into oscillation. This circuit 31, which can also be positioned on a wall defining the appliance internal cavity 10 in proximity to the aperture 27 in the housing side 11, is connected to the control unit 21 for the appliance operation so as to receive therefrom the information to be transmitted, remotely or without wires, to the interface 1, together with the energy required for its operation. In this respect, the oscillating signal which transports the operating energy for the interface 1, is modulated with the information to be transmitted thereto, by the modulation circuit 44 described hereinafter.

The interface 1, if suitably formed, can also transfer other data or commands to the unit 21 such as to modify the appliance operation in the desired manner.

The remote electromagnetic coupling between the resonant circuit 30 of the interface 1 and the oscillating circuit 31 need not necessarily be optimised, in the sense that the two circuits need not necessarily oscillate and resonate at the same frequency. A stage of synchronization of the oscillation and resonance frequencies of the two circuits 30 and 31 can however still be provided. This synchronization further optimises transfer of energy between the two circuits and of the signal superposed on it.

The resonant circuit 30 of the interface 1 is located within an electric circuit 33 comprising a high charge capacity capacitor 34 (supercapacitor) able to accumulate energy and enable correct operation of the interface 1. This energy is therefore received by the electromagnetic or radio connection with the circuit 31, so that the interface 1 does not require a battery. Alternatively a battery can be provided for partial operation of the interface or photovoltaic cells can be provided for charging the supercapacitor, the cells being disposed in a suitable position on the casing 5 of the interface 1. As a further alternative, these photovoltaic cells can directly power the electric circuit 33 of the interface 1. The circuit 33 also comprises a further demodulator circuit 41 to control the display unit 2 or the panel 3; in particular, this demodulator 41 powers the LEDs 39 of this latter.

An optional pushbutton 40 can be provided to activate the interface 1. The display circuit can also include a liquid crystal display (LCD).

Figure 1:
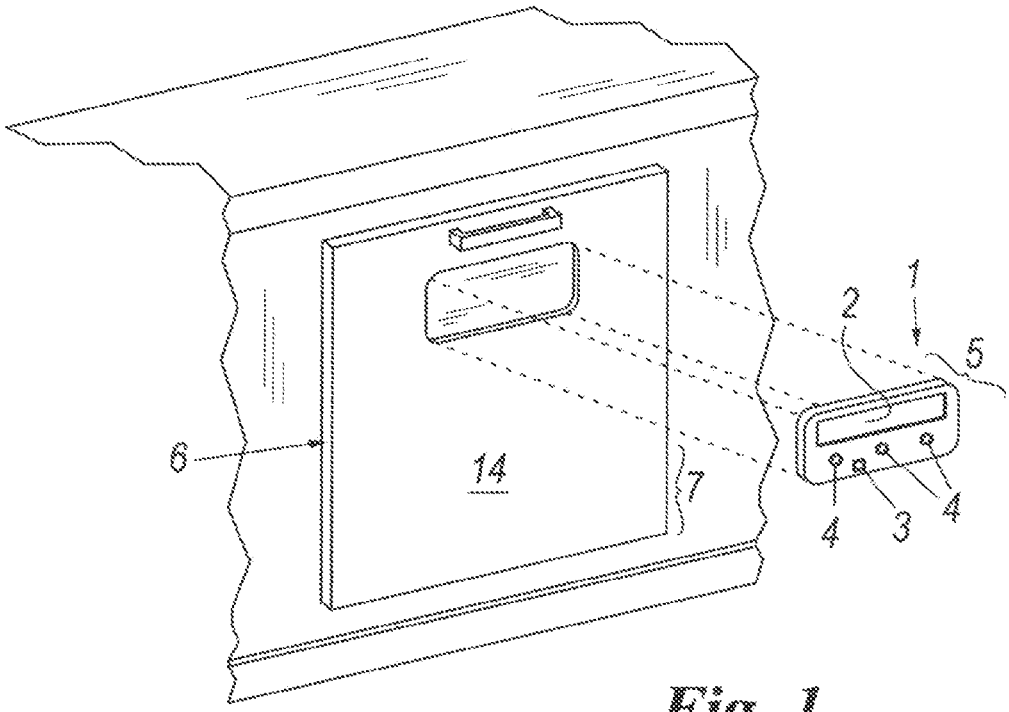
FIG. 1 is an exploded perspective view of an interface during its coupling to a household electrical appliance.
Figure 2:
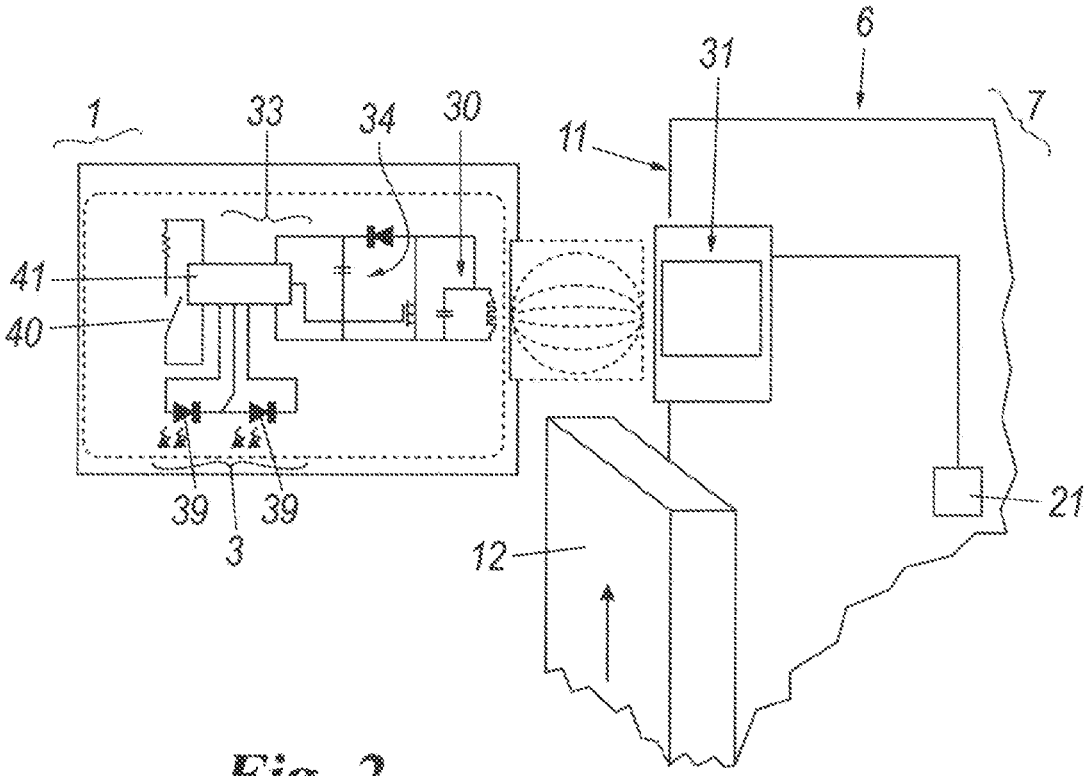
FIG. 2 is a schematic view of an interface and an electrical appliance with which it is associated.
Figure 3:
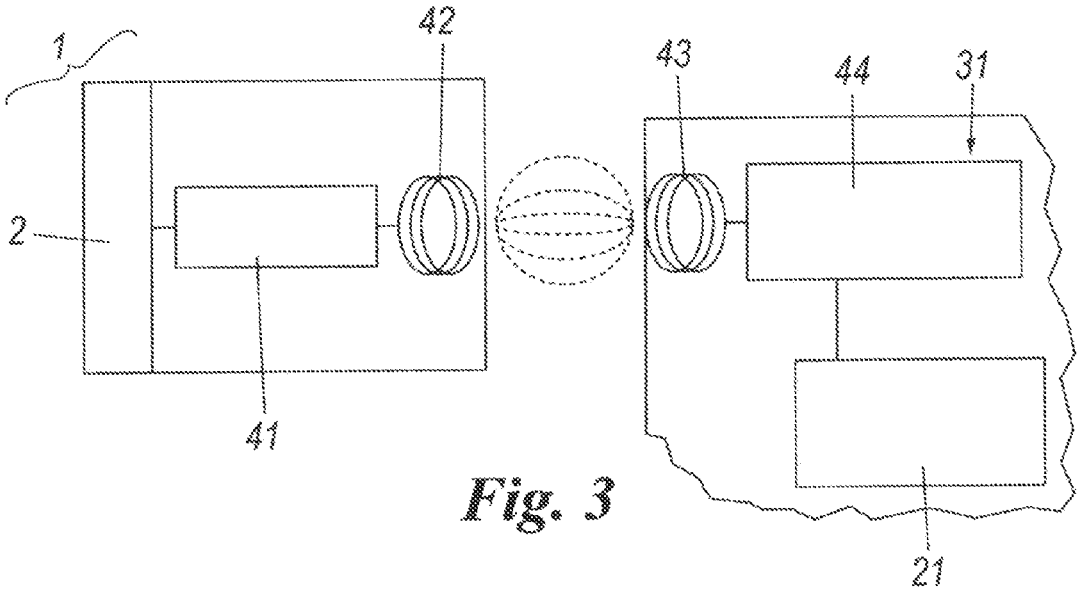
FIG. 3 shows a block diagram of the interface and of the electrical/electronic circuit of the electrical appliance with which it cooperates.

In its simplest form, as shown in FIG. 3, in which it can only receive data from the household electrical appliance, the interface 1 comprises the demodulator 41 connected to an antenna 42 (or magnetic field generator), formed by the resonant circuit 30, as in the case of the electromagnetic coupling.

By virtue of the demodulator 41, a signal superposed on the powering energy can be decoded in order to selectively activate the output elements (LEDs or LCD elements), and possibly enable data entry elements (keys) of the user interface 1.

Another antenna 43 (or magnetic field generator) is associated with the circuit 31 comprising (again in its simplest form) the aforesaid modulator 44, to modulate the oscillating signal with the signal to be transferred to the interface 1. In the more complex form in which the interface 1 can provide data to the unit 21, the demodulator 41 becomes a modulator/demodulator as does the modulator 44.

By virtue of the invention, it therefore becomes possible to associate a user interface 1 with a paneled (or non-paneled) electrical appliance without having to hole the panel (or the door or other part of the appliance housing), without cables and without modifying the kitchen unit. Removal of the electrical connection cables between the (remote) interface 1 and the unit 21 reduces the possibility of installation error or the possibility of short-circuits or cable breakages during movement of the door on which the interface is positioned.

Moreover, this latter can be easily mounted by the user without any need of intervention by a specialized operator. The only care required is to associate the interface 1 with the door in a suitable position such that it faces the circuit 31 present in the appliance housing 6. In this manner, energy and signals can be transferred via a usual appliance cover panel of good appearance.

As a further possibility, a variation of the amplitude of the signal in the oscillating circuit 31 can be used to detect when the door of the appliance is open or closed. In fact, whenever metallic mass (for instance the door itself or a metallic plaque associated with a non metallic door) is included in the door construction in the proximities of the coil 43 which belongs to the oscillating circuit 31, it causes relevant amplitude variations of the signal on the coil 43 (the antenna), enabling to the control 21 to discriminate between the two door positions.

Additionally, the interface 1 can be used to interact, without wires, with a plurality of household electrical appliances selected from a menu or list. To simplify this selection, the user can choose to select the appliance with which to communicate only by moving the interface 1 close to the appliance. In this case the interface is activated to "dialogue" with the closest appliance on the basis of the force of the remote signal (RSSI).

Figure 5:
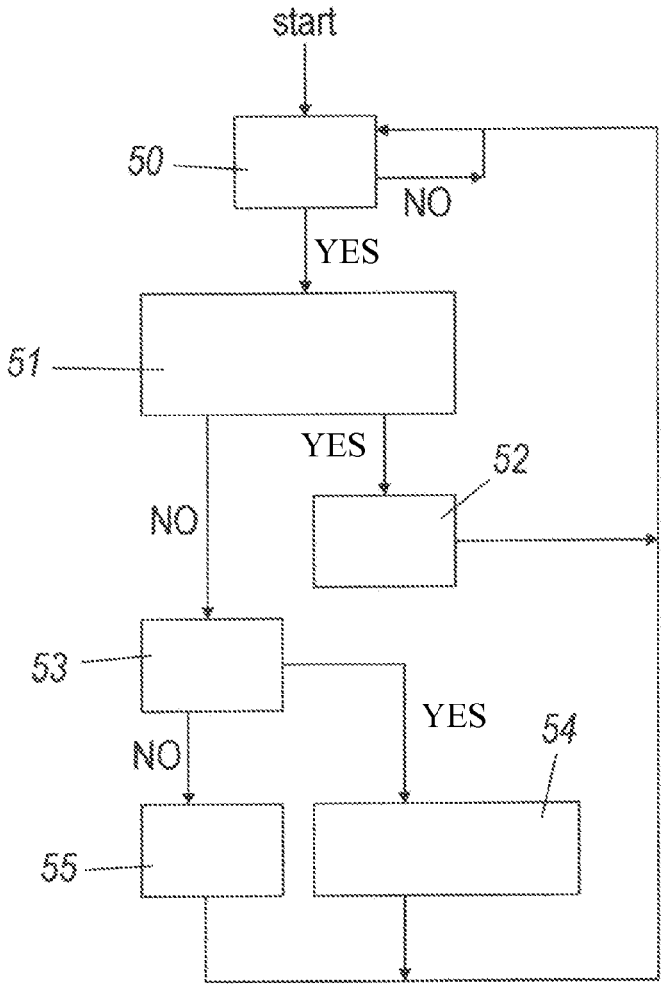
FIG. 5 is a flow diagram of a method of inserting an electrical appliance provided with the interface of the invention into a network of household electrical appliances of a kitchen.

By virtue of the invention, a household electrical appliance already purchased by a user and arranged for this functionality can also be associated with an interface 1. For this, a radio-transmitter module has to be applied to the usual appliance control unit to enable "dialogue" with the interface 1 and hence form an electrical appliance "network". The method of forming the network and the manner in which a new electrical appliance is inserted into the network are shown in FIG. 5.

For these, after initiating the procedure (START), block 50 checks whether information indicating the presence of an electrical appliance has been received; if positive, block 51 checks whether the information originates from an appliance already in the network. If this is the case, the data received are processed (block 52), whereas in the opposite case, block 53 checks whether the force of the radio signal is such as to enable the electrical appliance to be inserted into the network. If the response is positive (block 54), the new electrical appliance is inserted into the network; in the opposite case (block 55), the data reading is discarded.

Figure 6:
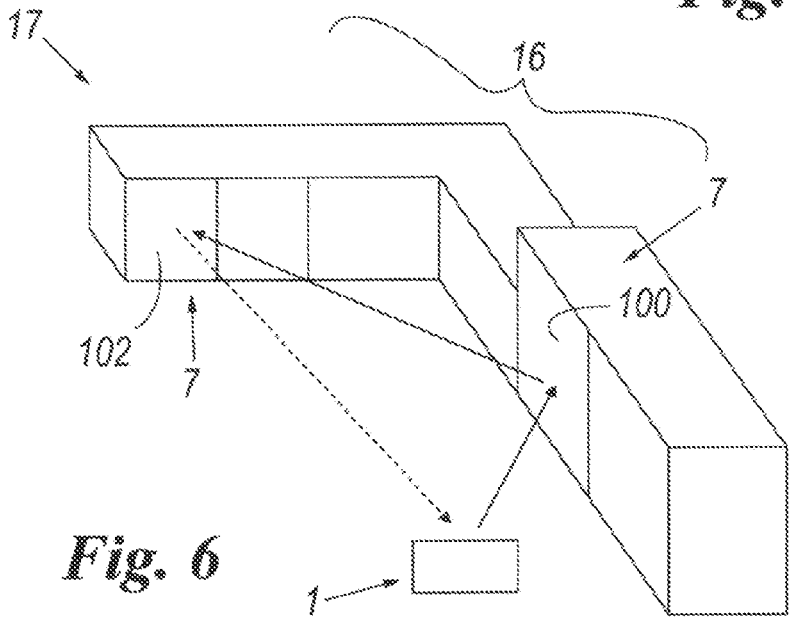
FIG. 6 is a perspective schematic view of a kitchen provided with electrical appliances connected into a network.

In a further embodiment (see FIG. 6), if the signal from a first appliance 100 is "stronger" than that originating from a second appliance 102, the first appliance 100 is used (and commanded) as a signal repeater, and the information to the second appliance 102 is fed by the first appliance 100.

Moreover, in the appliance network the various appliances can be differently synchronized via the interface 1, so that their data do not become superposed, it being also possible to choose a main appliance within the network with which all the network appliances are synchronized. If this main appliance or leader is deactivated, the second network appliance chosen as the appliance immediately following the main appliance intervenes. It should also be noted that synchronization of the various appliances can also be achieved by providing an internal clock individual to each of them; if an appliance has an external clock receiver (or if its own clock receives the time from a remote time provider, such as an atomic clock or via the internet), it can share information on its operation or its synchronization with all the other electrical appliances connected to the network. Appropriate food information can also be shared between several appliances of the network for the purpose of food preparation and storage.

In the case of clock synchronization, the leader appliance is preferably that presenting the highest precision of its own internal clock, and associating in this sense a quality index with the clocks associated with the individual appliances of the network. The indication of the clock quality factor together with the actual value of the clock is inserted into the information communication string towards the other network appliances, to enable the main appliance to be defined. The transmission of this communication can be periodically and automatically repeated, so avoiding the user having to carry out manual clock synchronization operations.

In addition, information on appliance operation (for example the foods contained in the refrigerator) can be shared, for the purpose of their preparation and storage, by several network appliances.

These latter can also be controlled via the interface 1 to optimize mains electricity consumption, so preventing mains overloading or making the appliances operate during those periods of the day in which electricity costs less than in other periods.

Finally, the interface 1 can operate without a battery, and is therefore of low construction cost and reduced environmental impact.

These characteristics are all achievable for a network of household electrical appliances by a single interface 1 as heretofore described.

A preferred embodiment of the invention has been described. Others are however possible in the light of the foregoing and are to be considered as falling within the scope of the following claims.

We claim:

1. A household appliance having an interior and an exterior, comprising:

a user interface removably fastened to the exterior of the appliance;

a first wire-less communication and transmission means disposed within the user interface for receiving wire-less data; and a second wire-less communication and transmission means disposed within the interior of the appliance, wherein the user interface is arranged to sense the presence of a plurality of household electrical appliances in an appliance network and the second wire-less communication and transmission means is configured to transfer data and power between the interior of the appliance and the user interface such that the user interface receives both data and operating energy through the second wire-less communication and transmission means.

2. The household appliance according to claim 1, wherein the first and second wire-less communication and transmission means transfer data bi-directionally.

3. The household appliance according to claim 1, wherein the user interface is fastened to an outer decorative panel attached to a door of the appliance.

4. The household appliance to claim 1, wherein the user interface is fastened mechanically to the appliance.

5. The household appliance according to claim 1, wherein the user interface is fastened magnetically to the appliance.

6. The household appliance according to claim 1, wherein the first and second communication and transmission means operate via electromagnetic coupling.

7. The household appliance according to claim 6, wherein the first wire-less communication and transmission means comprises a capacitor for accumulating energy and a demodulator for controlling the user interface, and the second wire-less communication and transmission means comprises a modulator member, wherein the demodulator is configured to communicate with the modulator member.

8. The household appliance according to claim 7, wherein the demodulator is also a modulator and the modulator member of the household appliance is also a demodulator, thus enabling data towards and from the user interface to be transferred from and towards the appliance.

9. The household appliance according to claim 7, wherein the demodulator includes a resonant circuit.

10. The household appliance according to claim 1, wherein the user interface further comprises an energy accumulation means to allow for battery free operation.

11. The household appliance according to claim 10, wherein the energy accumulation means is a high capacity capacitor, the capacitor being connected to the demodulator.

12. The household appliance according to claim 10, wherein the energy accumulation means is a high capacity capacitor connected to a photovoltaic cell.

13. The household appliance according to claim 1, wherein the user interface is arranged to cooperate with an electromagnetic signal which is the most intense of all signals emitted by the plurality of household electrical appliances in the appliance network.

14. A household appliance having an interior and an exterior, comprising:

a user interface fastened to the exterior of the appliance;

a first wire-less communication module disposed within the user interface; and a second wire-less communication module disposed within the interior of the appliance, wherein the second wire-less communication module is configured to transfer data and power between the interior of the appliance and the user interface such that the user interface receives both data and operating energy through the second wire-less communication and transmission module.

15. The household appliance according to claim 14, wherein the appliance is part of a network of appliances controllable by the user interface, the user interface can be coupled to any one of the appliances, the user interface cooperating with one of the appliances on the basis of the power or intensity of electromagnetic signals emitted by each of the appliances.

16. The household appliance according to claim 15, wherein the household appliance cooperates with the user interface by acting as a repeater for at least the electromagnetic signals originating from another electrical appliance of the appliance network and to direct the electromagnetic signals to the user interface.

17. The household appliance according to claim 14, further comprising an at least partially metallic door and a control unit, wherein the control unit is connected to the second wire-less communication module and is configured to discriminate between an open and a closed position of the door.

18. A network of household electrical appliances positioned in an inhabitable room, the network comprising a plurality of household electrical appliances, which could form part of the same combination of modular furniture units such as that of a kitchen, wherein the plurality of household electrical appliances cooperates with at least one remote interface applicable to one of the plurality of household electrical appliances, the cooperation occurring remotely and enabling the interface to at least display data relative to the operation of the plurality of household electrical appliances of the network of household electrical appliances;

wherein the user interface includes a first wire-less communication and transmission device disposed therein and a second wire-less communication and transmission device is disposed within the interior of a respective one of each of the plurality of household electrical appliances; and wherein the second wire-less communication and transmission device is configured to transmit data and power between each of the plurality of household electrical appliances and the user interface such that the user interface receives both data and operating energy through the second wire-less communication and transmission device.

19. The network of household electrical appliances according to claim 18, wherein each of the plurality of household electrical appliances is configured to generate an electromagnetic signal and the interface is arranged to cooperate with one of the plurality of household electrical appliances generating the most intense electromagnetic signal, the one of the plurality of household electrical appliances cooperating with the interface acting as a repeater for the electromagnetic signals generated by other ones of the plurality of household electrical appliances of the network and directed towards the interface but not cooperating with the interface.

* * * * *